United States Patent [19]

Koehler

[11] Patent Number: 4,692,729

[45] Date of Patent: Sep. 8, 1987

[54] DIRECT CURRENT ELECTROMAGNET HAVING A MOVEMENT OF TRANSLATION

[75] Inventor: Gérard Koehler, Ville d'Avray, France

[73] Assignee: La Telemecanique Electrique, Nanterre Cedex, France

[21] Appl. No.: 895,487

[22] Filed: Aug. 11, 1986

[30] Foreign Application Priority Data

Aug. 16, 1985 [FR] France ..... 85 12459

[51] Int. Cl.[4] ..... H01F 7/08

[52] U.S. Cl. ..... 335/259; 335/261; 335/265

[58] Field of Search ..... 335/229, 230, 234, 259, 335/261, 265, 270

[56] References Cited

U.S. PATENT DOCUMENTS 2,531,500 11/1950 Claytor ..... 335/258
2,734,153 2/1956 Soreng et al. ..... 335/262
2,915,681 12/1959 Troy ..... 335/261 X
4,553,121 11/1985 Logie ..... 335/261

FOREIGN PATENT DOCUMENTS 2520152 7/1983 France ..... 335/234
2554960 5/1985 France ..... 335/234
448240 3/1968 Switzerland ..... 335/272

*Primary Examiner*—George Harris
*Attorney, Agent, or Firm*—Young & Thompson

[57] ABSTRACT

A magnetic core (3) surrounded by a coil (1, 2) bears a first pole shoe (4) forming a large-surface air-gap with two zones (5*a*, 6*a*) of two armatures (5, 6) fixed to one another and disposed magnetically in parallel.

The core (3) is continued beyond the coil and at this end bears a second pole shoe (9) which together with two other zones (5*c*, 6*c*) of the armatures forms a second large-surface air-gap disposed magnetically in series with the first.

10 Claims, 5 Drawing Figures

DIRECT CURRENT ELECTROMAGNET HAVING A MOVEMENT OF TRANSLATION

This invention relates to a direct-current electromagnet having a movement of translation.

It is well known that for a direct-current electromagnet there is an optimum air-gap distance at which the product of the force of attraction at that distance and the remaining travel is at a maximum.

The reason for this is that when said distance decreases, the force of attraction does not tend towards infinity, because of the magnetic saturation effects and the presence of residual or anti-remanence air-gaps and the product decreases to tend towards zero. On the other hand, when this distance increases, the force of attraction decreases substantially as the square of the travel and the product decreases also. It has been found by experiment that this optimum air-gap is in the region of one-tenth of the square root of the air-gap area.

To obtain this optimum air-gap in order to overcome resistant mechanical work, such as that of the contacts of a relay, the air-gap surface generally has to be increased with respect to the iron section, e.g. by providing a pole shoe of an area twice that of the iron at the end of a core.

At the same time, rotary amplification can be applied by pivoting the armature on one end of an arm of a U, the other arm of which bears the coil. Thus the closing travel of the air-gap can be smaller than the useful movement transmitted by the electromagnet, e.g. to the contacts of a relay.

If, however, the armature is to have a movement of translation, e.g. in order directly to control double-break contacts in contactors, it is no longer possible to use the expedient of rotary amplification. One might consider using a plunger core, but this arrangement is accompanied by considerable sliding reluctance. It is therefore necessary to use a configuration comprising two air-gaps in series (a flat armature facing a U or an E, or a U-shaped or E-shaped armature facing a yoke of the same shape).

With two air-gaps in series, to obtain the same characteristics (reluctance, inductance, flux, forces) as with a single air-gap, the surface of each air-gap must be doubled (total air-gap reluctance unchanged, flux unchanged giving two forces each equal to half the previous force).

To obtain the effects of doubling the surface of a single air-gap it would then be necessary to have two pole shoes each four times the iron section. Not only would the identical E or U-shaped circuits opposite no longer be usable, but, even with a flat armature, the size would become prohibitive and the leakage flux considerable.

To solve this problem, it has been proposed to have air-gap surfaces which are not flat but dihedral. However, it is not possible to go beyond the equivalent of doubling the surfaces. And that gives rise to guidance problems. In FR-A-2 522 871, one of the air-gaps is of the overlapping type, and hence of low reluctance, but the corresponding surfaces must be covered with a plastic such as polytetrafluorethylene, which makes construction a sensitive and complicated matter without eliminating the risks of wear and jamming.

The object of this invention therefore is to propose a direct current electromagnet structure having a movement of translation and enabling two air-gaps to be provided in series, each having a surface up to ten times greater than the iron section so as to give the optimum conditions of a single large-shoe rotary-amplification air-gap despite restricted size and simple construction.

The invention therefore relates to a direct current electromagnet having a movement of translation, comprising a first magnetic assembly and a second magnetic assembly, said assemblies being movable with respect to one another, and a winding wound on a coil former surrounding a core which belongs to the first assembly and one end which is provided with a pole shoe facing a first zone of the second assembly, thus defining a first large-surface air-gap.

According to the invention, the electromagnet is characterised in that the second end of the core is continued beyond the coil former and is provided with a second pole shoe, and the second magnetic assembly has a second zone disposed between the coil former and the second pole shoe, thus defining with the latter a second large-surface air-gap disposed magnetically in series with the first air-gap and closing simultaneously therewith.

Thus each of the two air-gaps in series is at one of the axial ends of the coil and can therefore have a very large surface without affecting the size of the electromagnet in a plane perpendicular to the axis of the coil. The size in the direction of the coil axis is hardly increased by the presence of the second air-gap.

Other features and advantages of the invention will be apparent from the following description.

In the accompanying drawings, which are given by way of example without limiting force, FIG. 1 is a partial section of an electromagnet according to the invention on the line I—I in FIG. 2;

Figure 1:
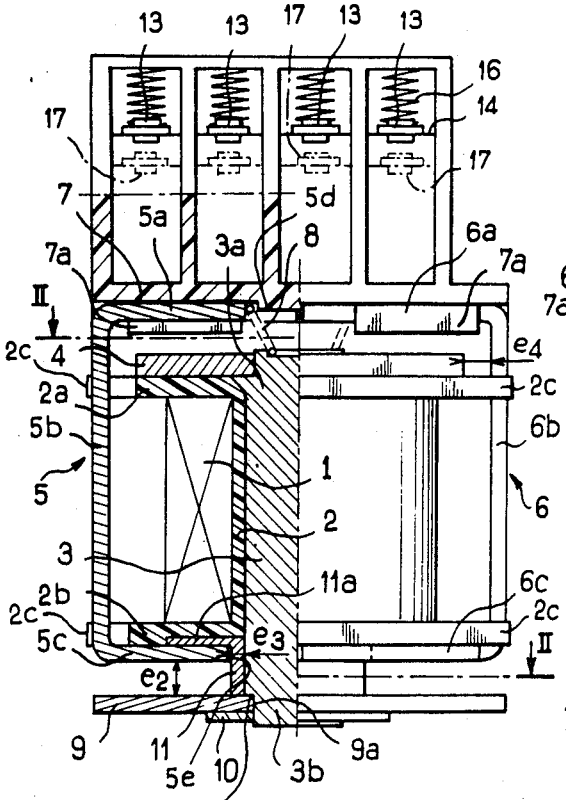
Figure 3:
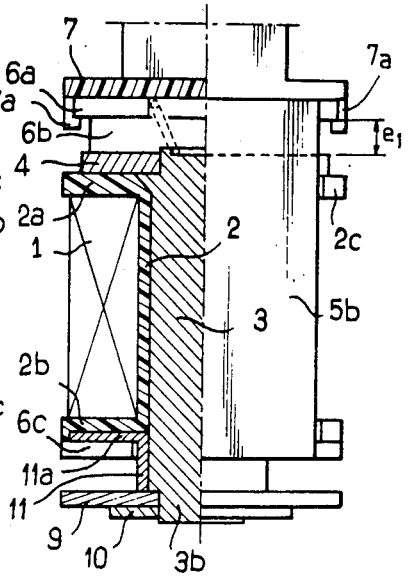
FIG. 3 is a partial section on the line III—III in FIG. 2.
Figure 2:
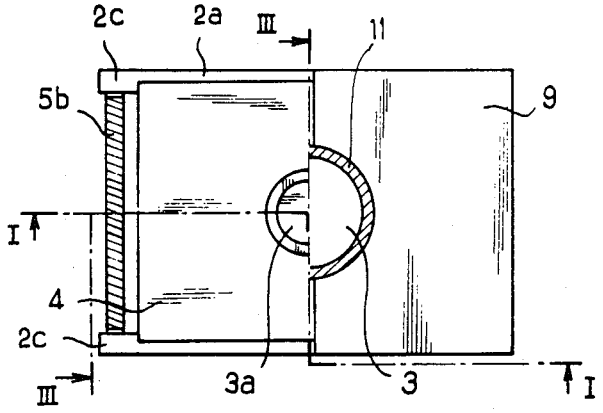
FIG. 2 is a section on the line II—II in FIG. 1.

The electromagnet shown in FIGS. 1 to 3 comprises a winding 1 wound around a coil former 2, the former being of an insulating plastic. The term coil is used to denote the complete winding 1 and its former 2.

The former 2 surrounds a magnetic core 3 belonging to a first magnetic assembly, which in this example is fixed.

A first end 3*a* of the core 3 is provided with a pole shoe adjacent an outer surface of a cheek 2*a* of the former 2. This pole shoe is a pole shoe 4 fitted immovably on the end 3*a* against a shoulder of the core 3.

As will be seen from FIG. 2, the cheeks 2*a* and 2*b* (only cheek 2*a* is visible) have a generaly rectangular shape and the pole shoe 4 has a rectangular shape of a length and width close to those of the cheeks 2*a* and 2*b*.

The electromagnet also comprises a second magnetic assembly, which is movable in this example, comprising two magnetic armatures 5 and 6 disposed symmetrically on either side of the coil axis.

Each armature 5, 6 comprises a flat central zone 5*b*, 6*b* disposed next to the coil, parallel to its axis, and guided for translation parallel to said axis between two pairs of lugs 2*c* each borne by one of the cheeks 2*a*, 2*b*. The two central zones 5*b*, 6*b* are disposed on either side of the coil parallel to one another.

At the end of the central region 5*b*, 6*b* adjacent the pole shoe 4 the armatures 5, 6 are bent at right angles towards one another in order that each may form a first air-gap zone 5*a*, 6*a* facing the pole shoe 4 on the side remote from the cheek 2*a*. Zones 5*a*, 6*a* of the armatures 5, 6 thus form with the pole shoe 4 a first variable air-gap e1 having a large surface (4/5*a*, 6*a*). The contacting of the zones 5*a*, 6*a* on the pole shoe 4, i.e. closing of the first air-gap, defines one of the ends of the movement of translation of the armatures 5, 6.

The armatures 5, 6 are fixed to one another by a plastic support 7 in which are mounted the movable contacts 13 of a contactor, of which the electromagnet forms the driving element. The movable contacts 13 are urged against an abutment 14 by springs 16. To fix the armatures 5, 6 to the support 7, each zone 5*a*, 6*a* is retained against the bottom surface of the support 7 between two guides 7*a* provided on two opposite edges thereof. Thus after the coil and first magnetic assembly have been fitted, and the movable contact and fixed contact supports (only the fixed contacts are shown in chain lines at reference 17), the two armatures 5, 6 can be fitted by introducing them laterally, on either side of the coil, in their respective pairs of guides 7*a*.

In the installed position, the armatures 5 and 6 abut one another by the free end of their zone 5*a*, 6*a*. However, they define between them a circular opening 5*d* which positions the wide end of a conical helical compression spring 8 mounted between the bottom surface of the support 7 and the end 3*a* of the core 3 appearing through the hole for fitting the pole shoe 4.

According to the invention, the second end 3*b* of the core 3 is continued beyond the coil former 2 and is provided, some distance beyond the cheek 2*a* with a second pole shoe in the form of a shoe 9 having a central hole 9*a* by means of which it is engaged and crimped around the end 3*b* abutting a shoulder 3*c* of the core. The pole shoe 9 has a generally rectangular shape of a length and width substantially equal to the corresponding dimensions of the movable assembly. To ensure a constant radial dimension for the iron section at the passage of the core 3 to the pole shoe 9 an iron washer 10 is crimped on the end 3*b* against the pole shoe on the side remote from the coil 1, 2.

According to another important feature of the invention, at the end of their central zone 5*b*, 6*b* adjacent the end 3*b* of the core the armatures 5, 6 are bent a second time towards one another through 90° to form a second air-gap zone 5*c*, 6*c* disposed between the cheek 2*b* and the pole shoe 9 to form a second variable air-gap e2 (9/5*c*, 6*c*) disposed magnetically in series with the first e1. In the end position in which the first air-gap e1 is closed, the second air-gap e2 is also closed. In the example illustrated, the movable contacts 13 are then applied to the fixed contacts 17 with a force defined by the springs 16.

When the winding 1 is not energised, the armatures 5, 6 are returned by the spring 8 into the end position shown in the Figures, in which their zones 5*c*, 6*c* abut the cheek 2*b* of the former 2.

Like the first air-gap e1, the second air-gap e2 has a remarkably wide surface, e.g. five to ten times the iron section of the magnetic circuit, i.e. the section of the core 3 or alternatively the sum of the sections of the central zones 5*b* and 6*b* of the armatures 5 and 6 which are magnetically in parallel. The two air-gaps preferably have an equal surface.

A copper or brass sleeve 11, i.e. made of a non-magnetic but electrically conductive material, is fitted on the core 3 between the second pole shoe 9 and the adjacent cheek 2*b* of the coil former. The sleeve 11 has a number of functions. First, it fixes the axial spacing between the pole shoe 9 and the coil former 2. Secondly, its outside diameter is close to the inside diameter of an orifice 5*e* which is defined jointly by the facing ends of the zones 5*c* and 6*c*. Thus the orifice 5*e* co-operates with the sleeve 11 to complete the guidance for the translation of the armatures 5 and 6 while leaving between them and the core 3 an air-gap of fixed spacing e3 which minimises the magnetic leakages.

Sleeve 11 also acts as a delay ring which reduces the over-voltage produced by an abrupt break to the supply to the winding 1.

On the side adjacent the cheek 2*b*, the sleeve 11 has a collar 11*a* which mechanically supports the cheek 2*b* to prevent the cheek 2*b* in the course of time from distorting under the pressure of the winding 1 and reducing the maximum possible spacing of the air-gap e2.

It should also be noted that an air-gap e4 of constant spacing is reserved between the edge of the pole shoe 4 and the central zone 5*b* or 6*b* of each armature 5, 6 to minimise the unwanted magnetic leakages between the pole shoe 4 and each armature 5, 6.

The invention enables each variable air-gap to be given a surface about ten times that of the iron section of the core 3, and this is magnetically equivalent to a magnetic circuit containing just one air-gap having a surface five times greater than that of the core or alternatively a magnetic circuit having a single air-gap whose surface is 2.5 times greater than that of the core section in combination with an amplification which doubles the effective travel by rotation.

Of course if the resulting air-gap surface is excessive, it is easy to reduce it. In this way it is possible to choose an optimum air-gap surface. There is in fact no point in excessively increasing the air-gap surface because then the iron reluctance becomes close to that of open-circuit air-gaps and, on the other hand, the closed magnetic circuit force reduces to the point where it involves difficulties in compressing the springs of the power contacts.

If the sleeve 11 is dispensed with, the core can be slidable in the coil former, the parts such as 5 and 6 being fixed against the cheek 2*c* of the coil former.

Figure 4:
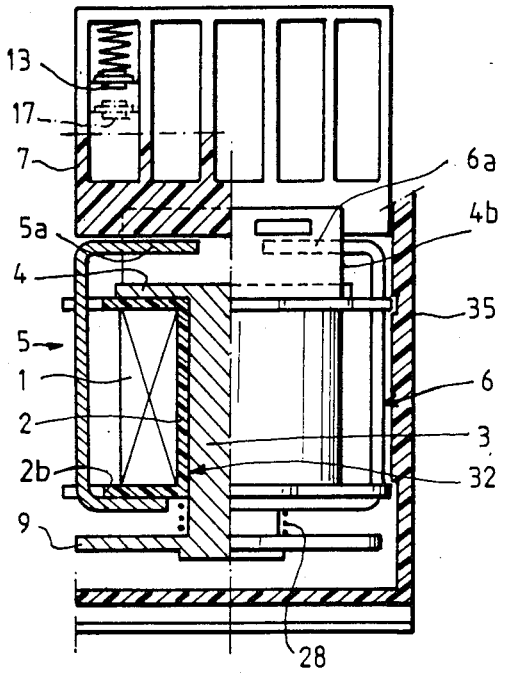
FIG. 4 is a similar view to FIG. 1 relating to an alternative embodiment.
Figure 5:
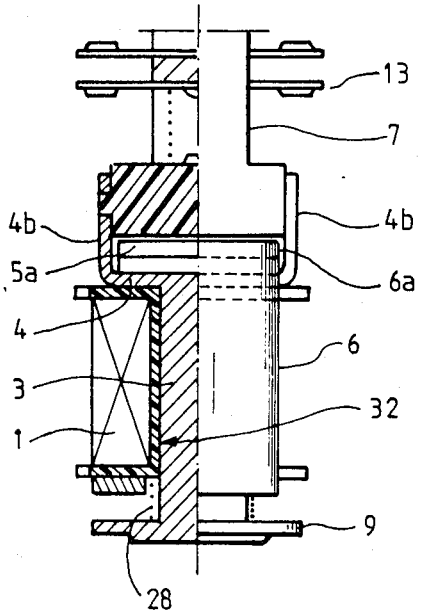
FIG. 5 is a similar view to FIG. 3 relating to the same embodiment.

FIGS. 4 and 5, which are simplified versions of FIGS. 1 and 3 described in detail hereinbefore, illustrate this alternative embodiment. In this case the magnetic assembly 5, 6 forms the fixed assembly and is held with the coil 1, 2 in a casing 35 while the assembly 3, 4 is the movable assembly.

Thus the core 3 is mounted slidably in the bore 32 of the coil former 2 while a return spring 28 of the movable assembly 3, 4 is fitted on the core between the second pole shoe 9 and the adjacent cheek 2*b* belonging to the coil former 2.

Also, by analogy of operation with the preferred embodiment described above, the first pole shoe 4 is bent substantially at a right angle on the side remote from the second pole shoe 9 and on either side of the insulating member 7 bearing the movable contacts 13, to form zones 4*b* which move jointly with the insulating member 7 while of course the latter is disconnected from the zone 5*a*, 6*a* of the fixed assembly 5, 6.

Of course the invention is not limited to the examples described and illustrated and numerous modifications can be made to these examples without departing from the scope of the invention.

If air-gaps having a surface five times greater than the core section are considered satisfactory, one of the armatures 5, 6 can be dispensed with.

Just one armature can be provided without reducing the air-gap surfaces provided that one of the air-gap zones of this armature is formed with a hole for the passage of the core extension bearing the pole shoe, such as 9.

The core may have a rectangular section and, for example, be made from a stack of laminations or alternatively two plates bent at right angles in opposite directions beyond each end of the coil so as to form the core and its two pole shoes in one operation.

I claim:

1. A direct current electromagnet having a movement of translation, comprising a first magnetic assembly (3, 4) and a second magnetic assembly (5, 6), said assemblies being movable with respect to one another, and a winding (1) wound on a coil former (2) surrounding a core (3) which belongs to the first assembly and one end (3*a*) of which is provided with a pole shoe (4) facing a first zone (5*a*, 6*a*) of the second assembly (5), thus defining a first large-surface air-gap (4/5*a*, 6*a*), characterised in that the second end (3*b*) of the core (3) is continued beyond the coil former (2) and is provided with a second pole shoe (9), and the second magnetic assembly (5, 6) has a second zone (5*c*, 6*c*) disposed between the coil former (2) and the second pole shoe (9), thus defining with the latter (9) a second large-surface air-gap (9/5*c*, 6*c*) disposed magnetically in series with the first air-gap (4/5*a*, 6*a*) and closing simultaneously therewith.

2. An electromagnet according to claim 1, characterised in that the surface of each air-gap (4/5*a*, 6*a*); (9/5*c*, 6*c*) is five to ten times greater than the iron section of the core (3).

3. An electromagnet according to claim 1, characterised in that the second magnetic assembly (5, 6) comprises a central zone (5*b*, 6*b*) substantially parallel to the axis of the coil (1, 2) and is bent substantially at a right-angle towards the axis of the coil and on either side thereof to form the first zone (5*a*, 6*a*) and the second zone (5*c*, 6*c*) of the second assembly (5, 6).

4. An electromagnet according to claim 3, characterised in that the second magnetic assembly (5, 6) comprises two identical U-shaped half-armatures (5, 6) which are fitted laterally on either side of the coil (1, 2) and each fixed to one end of the bottom surface of an insulating member (7) bearing movable contacts (13).

5. An electromagnet according to claim 1, characterised in that a sleeve (11) of non-magnetic but electrically conductive material, such as copper, is fitted on the core (3) between the second pole shoe (9) and an adjacent cheek (2*b*) belonging to the coil former (2).

6. An electromagnet according to claim 5, characterised in that the sleeve (11) has a collar (11*a*) for reinforcing said cheek (2*b*).

7. An electromagnet according to claim 1, characterised in that the second magnetic assembly (5, 6) comprises two identical U-shaped half-armatures (5, 6) extending laterally on either side of the coil (1, 2) and each fixed against a cheek (2*c*) of the coil former (2).

8. An electromagnet according to claim 1, characterised in that the pole shoe (4) with which the first end (3*a*) of the core (3) is provided is bent substantially at a right angle on the side remote from the second pole shoe (9) and on either side of an insulating member (7) bearing movable contacts (13), to form zones (4*b*) which move jointly with the insulating member (7).

9. An electromagnet according to claim 1, characterised in that a return spring (28) of the movable assembly (3, 4) is fitted on the core (3) between the second pole shoe (9) and an adjacent cheek (2*b*) belonging to the coil former (2).

10. An electromagnet according to claim 1, characterised in that the fixed assembly (5, 6) and the coil (1, 2) are held in a casing (35).

* * * * *